US006769277B1

(12) United States Patent
Chang

(10) Patent No.: US 6,769,277 B1
(45) Date of Patent: Aug. 3, 2004

(54) STRUCTURE OF A LOCKER

(76) Inventor: Wen-Kwei Chang, PO Box 82-144, Taipei (TW)

( * ) Notice: Subject to any disclaimer, the term of this patent is extended or adjusted under 35 U.S.C. 154(b) by 0 days.

(21) Appl. No.: 10/347,381

(22) Filed: Jan. 21, 2003

(51) Int. Cl.[7] ..... E05B 67/02

(52) U.S. Cl. ..... 70/52; 70/38 A; 70/38 R; 70/20

(58) Field of Search ..... 70/52, 38 A, 448, 70/31, 39, 462, 38 R, 49, 53, 20

(56) References Cited

U.S. PATENT DOCUMENTS 3,835,675 A * 9/1974 Lippisch ..... 70/38 A
4,811,578 A * 3/1989 Masoncup et al. ..... 70/38 B
5,230,231 A * 7/1993 Liou ..... 70/38 A
5,394,711 A * 3/1995 Pitkanen ..... 70/38 A
5,755,121 A * 5/1998 Crass ..... 70/52
5,896,761 A * 4/1999 Chen ..... 70/38 A
6,069,563 A * 5/2000 Kadner et al. ..... 340/571
6,227,016 B1 * 5/2001 Yu ..... 70/30
6,233,985 B1 * 5/2001 Huang ..... 70/49
6,393,876 B1 * 5/2002 Matyko ..... 70/38 A
6,539,754 B1 * 4/2003 Fang ..... 70/52
2002/0078720 A1 * 6/2002 Watts ..... 70/38 A

* cited by examiner

*Primary Examiner*—John B. Walsh
(74) *Attorney, Agent, or Firm*—Leong C. Lei

(57) ABSTRACT

A locker structure which includes two hemispherical shells each correspondingly mounted to each other, each of the hemispherical shells having corresponding locking-core hole, latching hole, lock-hook hole and locking hole, and the lock-latching hole position is provided with a steel bead or lock-latching element, and the lock-latching hole position is a fixing end having a lock-hook, and the locking hole position allows the actuating end of the locking hook to be inserted and to lock the locker, or the two elements are disengaged to unlock the locker, and the exterior of the two hemispherical shells is mounted with a steel sleeve and the position of the top, bottom of the steel sleeve and the two hemispherical shells are disposed with a steel plate such that the steel sleeve and the structure of the steel plate cover the two hemispherical shells to form a locker.

1 Claim, 2 Drawing Sheets

STRUCTURE OF A LOCKER

BACKGROUND OF THE INVENTION

1. Technical Field of the Invention

The present invention relates to a locker, and in particular, to a structure of a locker having two hemispherical shells mounted to each other.

2. Description of the Prior Art

Taiwan Patent Publication No. 138048 entitled "Multi-functional Cable Locker" discloses a locker having a cable which is made from a flexural material, a fastener having a clipping hole allowing one end of the cable to fasten and the center portion being a spring engaging slot and the lower end formed into a fastener. The spring is mounted at the fastener of the clipping head and the end of the fastener is engaged at the spring engaging slot. A locking head having one end being provided with a fixing iron and the interior of the fixing iron is provided with a clipping hole for the insertion of the cable at one end. The other side of the locking head is provided with a locking hole for the insertion of the fastener.

Taiwan Patent Publication No. 158303 entitled "An Improved Structure of A Multi-functional Steel cable Locker" discloses a locker having a locker body formed from the stacking of metallic plates and the plate provided with bolt hole and the locking core hole and the moveable hole. The bolt hole allows a spring and a sunken head nut to be placed thereto.

In view of the above structure, it is understood that the locker structure is formed by stacking of metallic plates which are then riveted. However, the process of fabrication of the conventional locker is complicated and the assembly of the components is tedious and troublesome.

Taiwan Patent Publication No. 204681 entitled "An Integrated Cable Locker Structure" disclose a locker having a tube, and the housing having a locking core hole, bolt hole and fastening hole. This locker is fabricated by casting and is convenient in assemble. However, the cast locker is weak and cannot withstand hard/strong impact.

Therefore it is a prime object of the present invention to mitigate the above drawbacks by providing a structure of a locker having two hemispherical shells each mounted to each other.

SUMMARY OF THE INVENTION

Accordingly, it is an object of the present invention to provide a structure of a locker having two hemispherical shells each correspondingly mounted to each other, each of the hemispherical shells contains corresponding locking-core hole, latching hole, lock-hook hole and locking hole, and the position of the lock-core hole is provided with a lock-core element, and the lock-latching hole position is provided with a steel bead or lock-latching element, and the lock-latching hole position is a fixing end having a lock-hook, and the locking hole position allows the actuating end of the locking hook to be inserted and to lock the locker, or the two elements are disengaged to unlock the locker, and the exterior of the two hemispherical shells is mounted with a steel sleeve and the position of the top, bottom of the steel sleeve and the two hemispherical shells are disposed with a steel plate such that the steel sleeve and the structure of the steel plate cover the two hemispherical shells to form a locker.

Yet a further object of the present invention is to provide a structure of a locker, wherein the lateral side of the lock-hook bole is provided with an insertion-peg hole.

Still another object of the present invention is to provide a structure of a locker, wherein the interior of the locking hole is disposed with an urging button and a spring.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following description are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
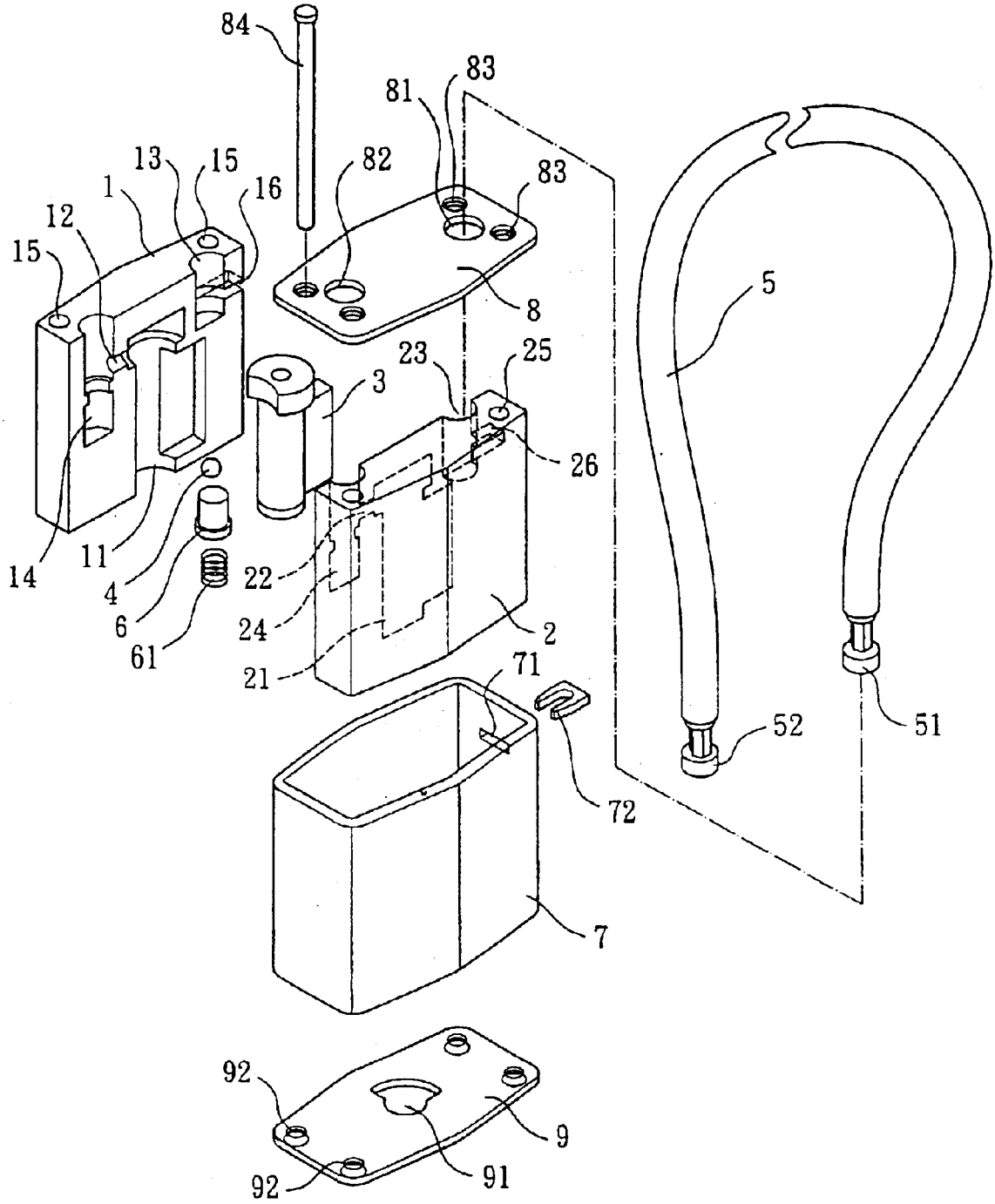
FIG. 1 is a perspective exploded view of the present invention.

Referring to FIG. 1, there is shown a structure of a locker having two hemispherical shells 1, 2 mounted to each other.

The corresponding faces of the two shells 1, 2 are provided with corresponding lock core holes 11, 21, latching holes 12, 22, lock-hook holes 13, 23 and locking holes 14, 24, and the corner positions of the two hemispherical shells 1, 2 are provided with rivet holes 15, 25, and the lateral sides of the hook holes 13, 23 are provided with insertion-peg holes 16, 26.

The lock-core holes 11, 21 positions are provided with a lock-core element 3, and the latching holes 12, 22 positions is provided with a steel bead 4 or a latching element. The lock-hook holes 13, 23 positions are provided with a fixing end 51 having a lock-hook element 5. The locking holes 14, 24 position is provided with an urging button 6 and a spring 61, and the locking holes 14, 24 allow the moving end 52 of the hook element 5 to be inserted thereto, and is fastened by the steel bead 4 or the latching element to form a locking or disengage with each other to form an unlocking.

After the interior of the hemispherical shells 1, 2 is mounted with the components, the exterior of the two hemispherical shells 1, 2 is mounted with a steel sleeve 7, which is adaptable to the external surface of the hemispherical shells 1, 2.

The lateral side of the steel sleeve 7 is provided with an insertion-peg hole 71 for the insertion of an U-shaped insertion peg 72. The peg 72 passes through the peg holes

16, 26 till the interior of the hook hole 13, 23. The fixing end 51 of the hook element 5 engages the hook holes 13, 23.

The hemispherical shells 1, 2, and the top and bottom face of the steel sleeve 7 are provided with a steel plate 8, 9. The top face of the steel plate 8 has a corresponding hook hole 81, locking hole 82 and rivet hole 83. The bottom face of the steel plate 9 is provided with corresponding key hole 91 and a rivet hole 92.

Finally, the rivet 84 is used to pass through the top and bottom face of the steel plates 8, 9 and the rivet holes 83, 15, 92 of the hemispherical shells 1, 2 so that the steel plates 8, 9, the steel sleeve 7 and the two hemispherical shells 1, 2 are riveted to form integrally as a locker.

Figure 3:
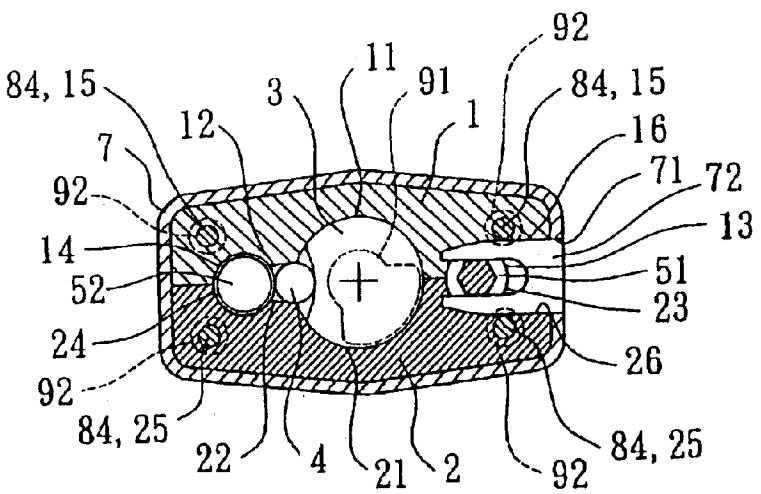
FIG. 3 is a sectional along line 3—3 of FIG. 2 of the present invention.
Figure 2:
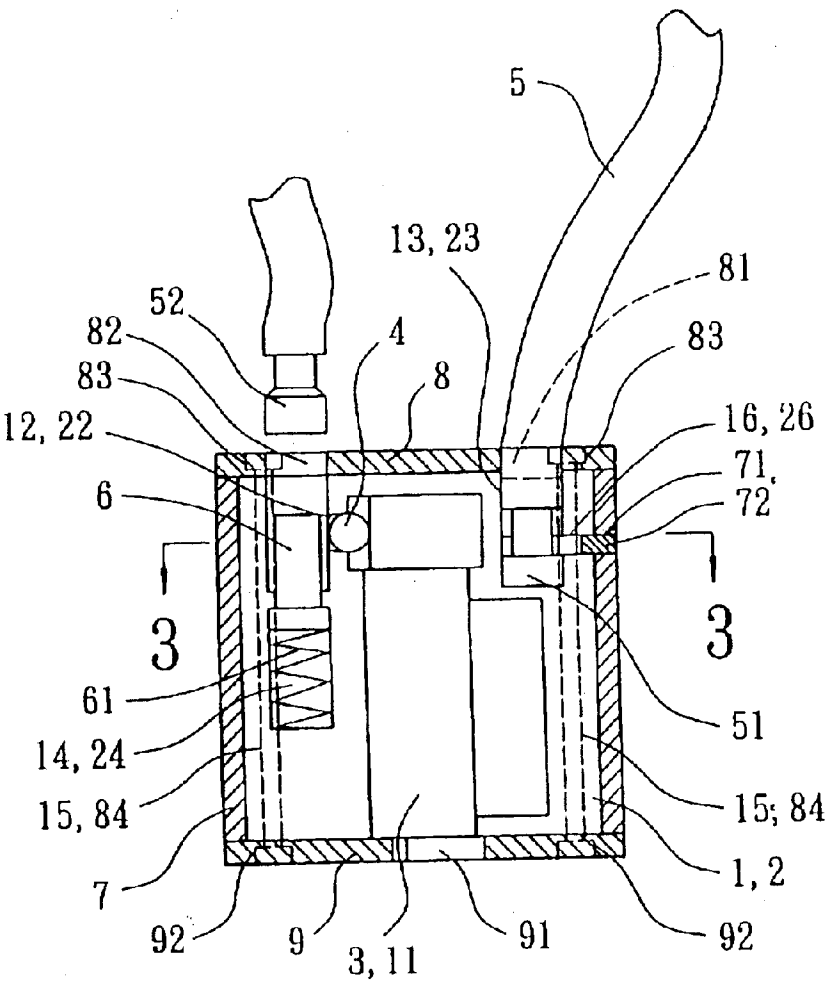
FIG. 2 is a sectional view of the interior structure of the present invention.

As shown in FIGS. 2 and 3, the locker is formed from two hemispherical shells 1, 2 and the interior of the hemispherical shells 1, 2 contains the components. The exterior of the shells 1, 2 is mounted with a steel sleeve 7, and the top, bottom face of the steel sleeve 7 is mounted with a steel plates 8, 9. Rivet 84 is used to rivet the component to form a locker.

The external of the locker encloses the steel sleeve 7 and the steel plates 8, 9, and these two components have been undergone heat treatment to enhance the strength thereof. Thus, the steel sleeve 7 and the steel plates 8, 9 are protected and the locker thus formed can resist damages or external impact.

The fixing end 51 of the hook element 5 is engaged with an U-shaped insertion peg 72 and is permanently secured within the hook holes 13, 23. The moving end 52 of the hook element 5 can be inserted into the locking holes 14, 24, and by means of the locking-core element 3, the steel bead 4 can be controlled so that the moveable end 52 is fastened, and the moveable end 52 of the hook element 5 is locked within the locking holes 14, 24 to form a locking or the lock-core element 3 is controlled to release the steel bead 4, then the moveable end 52 is urged out of the locking holes 14, 24 by the urging button 6 and the spring 61, such that the hook element 5 and the locker are disengaged and the locker is unlocked.

In view of the above, the locker in accordance with the present invention is provided with a strong structure which can resist external impact or damages. The structure is simple and the fabrication process is simple. Thus, the cost of production is low.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of a locker having two hemispherical shells each correspondingly mounted to each other, each of the hemispherical shells contains corresponding locking-core hole, latching hole, lock-hook hole and locking hole, and the position of the lock-core hole is provided with a lock-core element, and a lock-latching hole position is provided with a steel bead or lock-latching element, and the lock-latching hole position is a fixing end having a lock-hook, and the lock-latching hole position allows the actuating end of the locking hook to be inserted and to lock the locker, or the two elements are disengaged to unlock the locker, and the exterior of the two hemispherical shells is mounted with a steel sleeve and the position of the top, bottom of the steel sleeve and the two hemispherical shells are disposed with a steel plate such that the steel sleeve and the structure of the steel plate cover the two hemispherical shells to form a locker, wherein the lateral side of the lock-hook hole is provided with an insertion-peg hole, the interior of the locking hole is disposed with an urging button and a spring, the lateral side of the steel sleeve is provided with an insertion-peg hole for the mounting of a U-shaped insertion peg therein, the steel plate, the steel sleeve and the structure of the two hemispherical shells are provided with corresponding rivet holes allowing rivets to pass through for fixing.

* * * * *